United States Patent [19]

Burson et al.

[11] Patent Number: 4,653,823

[45] Date of Patent: Mar. 31, 1987

[54] ELECTRICAL CONNECTOR APPARATUS

[75] Inventors: Audrey F. Burson; Jerome M. Gotway, both of Indianapolis, Ind.

[73] Assignee: AT&T Information Systems, Inc., Murray Hill, N.J.

[21] Appl. No.: 776,061

[22] Filed: Sep. 13, 1985

[51] Int. Cl.[4] ..... H01R 9/09

[52] U.S. Cl. ..... 339/17 F; 339/75 MP; 339/274

[58] Field of Search ..... 339/17 F, 17 M, 17 LM, 339/75 MP, 61 M, 176 MF, 244 R, 273 R, 274; 24/115 L; 248/316.3

[56] References Cited

U.S. PATENT DOCUMENTS

| | | | |
|---|---|---|---|
| 3,579,283 | 5/1971 | Welburn | 339/274 |
| 4,373,764 | 2/1983 | Ulrich | 339/75 MP |
| 4,445,735 | 5/1984 | Bonnefoy | 339/17 M |

FOREIGN PATENT DOCUMENTS

| | | | |
|---|---|---|---|
| 147369 | 3/1951 | Australia | 248/316.3 |
| 30639 | 6/1981 | European Pat. Off. | 339/274 |
| 2508720 | 12/1982 | France | 339/17 F |

*Primary Examiner*—Neil Abrams

*Attorney, Agent, or Firm*—Ruloff F. Kip, Jr.; Harry L. Newman

[57] ABSTRACT

A jack has therein a longitudinal guideway in the back of which the free end of a printed wiring jack board projects longitudinally forward in the guideway and has laterally spaced conductive terminals on its top. The guideway is adapted to slidably receive a cartridge connector plug comprising a cartridge housing with a front opening for a longitudinal passage therein, a pair of axleless resiliently deformable lateral rollers in said housing back of said opening on opposite sides of said passage, and a flex bond unit longitudinally displaceably received in the passage and comprising a printed circuit plug board and a flexible sheet bonded to that board and having a forwardly projecting tail with laterally spaced conductive terminals matching those of the jack board. In use, the cartridge connector plug is id by hand into the jack guideway to cause insertion of the free end of the jack board into the cartridge opening to abut the front end of the plug board in the cartridge and to overlap with the mentioned tail so that the terminals on the jack board and tail register face to face in pairs. The jack board drives the plug board rearward in the cartridge housing to cause rolling of the rollers from first positions offset from the overlap to second positions on the overlap and at which the rollers press the registering pairs of terminals into firm contact to thereby connect circuitry on the plug board with circuitry coupled to the terminals on the jack board.

20 Claims, 11 Drawing Figures

ELECTRICAL CONNECTOR APPARATUS

FIELD OF INVENTION

This invention relates generally to apparatus for electromechanically connecting electrically conductive portions on separate insulative carriers. More particularly, this invention relates to apparatus of such kinds well adapted to effect such electromechanical connection of conductive portions which are on laterally wide insulative carriers as, for example, but without restriction, printed wiring boards, "flex" printed circuit sheets and flat cables.

BACKGROUND OF THE INVENTION

U.S. Pat. No. 4,420,206 issued Dec. 13, 1983 to G. J. Martyniak for "Electrical Connector" discloses a connector device for making electromechanical contact under pressure between conductive areas in face-to-face registration and respectively disposed on carriers in the respective forms of a lower circuit board and an upper flexible sheet resting on the top of the board. The device comprises (1) a downwardly open housing seated above the two carriers and having means coupling it to the lower of such carriers, and (2) a noncircular body received in such housing to be above the upper carrier and to be backed in its side away from such carrier by a top portion of such housing. That body is angularly movable within the housing and about an axis for the body between first and second angular settings for the body. The body is so dimensioned in its cross-sectional coordinates normal to such axis that, at its first setting, the body exerts no significant force on the carriers but, when moved to its second setting, the body wedges between the top portion of the housing and the top of the upper carrier to press down on the upper carrier so that the registering conductive areas in the two carriers are rendered in firm electromechanical contact with each other.

While the described Martyniak device has many advantages, it will be noted that, as the mentioned body thereof moves from its first to its second setting, such body makes wiping contact with the upper carrier, and that wiping contact may not alway be desired. Moreover, in order to adjust the mentioned body between its first and second settings, it is required that there be direct access to the device in the vicinity of the conductive areas pressed or to be pressed together by such device, and to provide such access in that vicinity may not always be convenient.

SUMMARY OF THE INVENTION

In contrast to the foregoing, an electrical connector apparatus in accordance with an aspect of the invention hereof is adapted to cooperate with a multi-ply assemblage comprising two insulative ply carriers having a longitudinal overlap and having respective electrically conductive portions in face-to-face registration within a region of the overlap. The apparatus takes the form of a device comprising lateral roller means, roller backing means providing a bearing surface for such roller means, and reaction means for such roller means and coupled by coupling means to the backing means for transmission of force therebetween. In the use of the device, the assemblage is placed between the roller means and reaction means to be contacted on opposite sides thereby. Then, the roller means is caused to roll on such assemblage and on such bearing surface while the roller means and reaction means exert oppositely directed inward forces on such ply carriers to produce firm electromechanical contact between the conductive portions thereon. The outward reactive forces developed on the backing means and reaction means by such inward forces are coupled together through the mentioned coupling means to mutually cancel each other.

Connector apparatus according to a further aspect of the invention hereof comprises a cartridge having a front opening for a longitudinal passage therein and containing two rollers disposed at its front and on transversely opposite sides of such passage to be separated by a transverse gap. Both of such rollers are backed on their sides away from such gap by wall portions of such cartridge. A first of the mentioned two carriers bears at least one of such conductive portions adjacent a free end of that carrier, and the second of such carriers bears at least one other of said conductive portions at its front end. The second carrier is mounted in the cartridge so that such front end is longitudinally displaceable into and out of the mentioned gap. In the use of the cartridge device, the free end of the first carrier is inserted through the mentioned cartridge opening to overlap with the front end of the second carrier and to become inserted in the gap and drive the second carrier rearwardly within the cartridge. Such driving is accompanied by rolling of the two rollers on their associated cartridge wall portions and on the two carriers so as to bring both rollers to a position at which they firmly press together the mentioned conductive portions which are respectively on those carriers.

A connector apparatus according to a yet further aspect of the invention hereof comprises an electrical equipment jack having therein a recessed guideway with an opening thereinto from the front of the jack, an insulative member mounted in the back of said guideway and having a free end bearing at least one of said conductive portions and projecting forward from such back centrally within said guideway, a cartridge slidably receivable in such guideway and having a front opening for insertion of said free end into said cartridge upon sliding of said cartridge into the guideway, the cartridge containing an insulative member bearing at least one other of said conductive portions, and means within the cartridge and operable upon such insertion for producing a firm electromechanical contact between such two conductive portions.

BRIEF DESCRIPTION OF THE DRAWINGS

For a better understanding of the invention, reference is made to the following description of a representative embodiment thereof as embodied in jack-plug connector apparatus and in a cartridge connector constituting the plug part of such apparatus, and to the accompanying drawings wherein.

DETAILED DESCRIPTION OF EMBODIMENT

Figure 1:
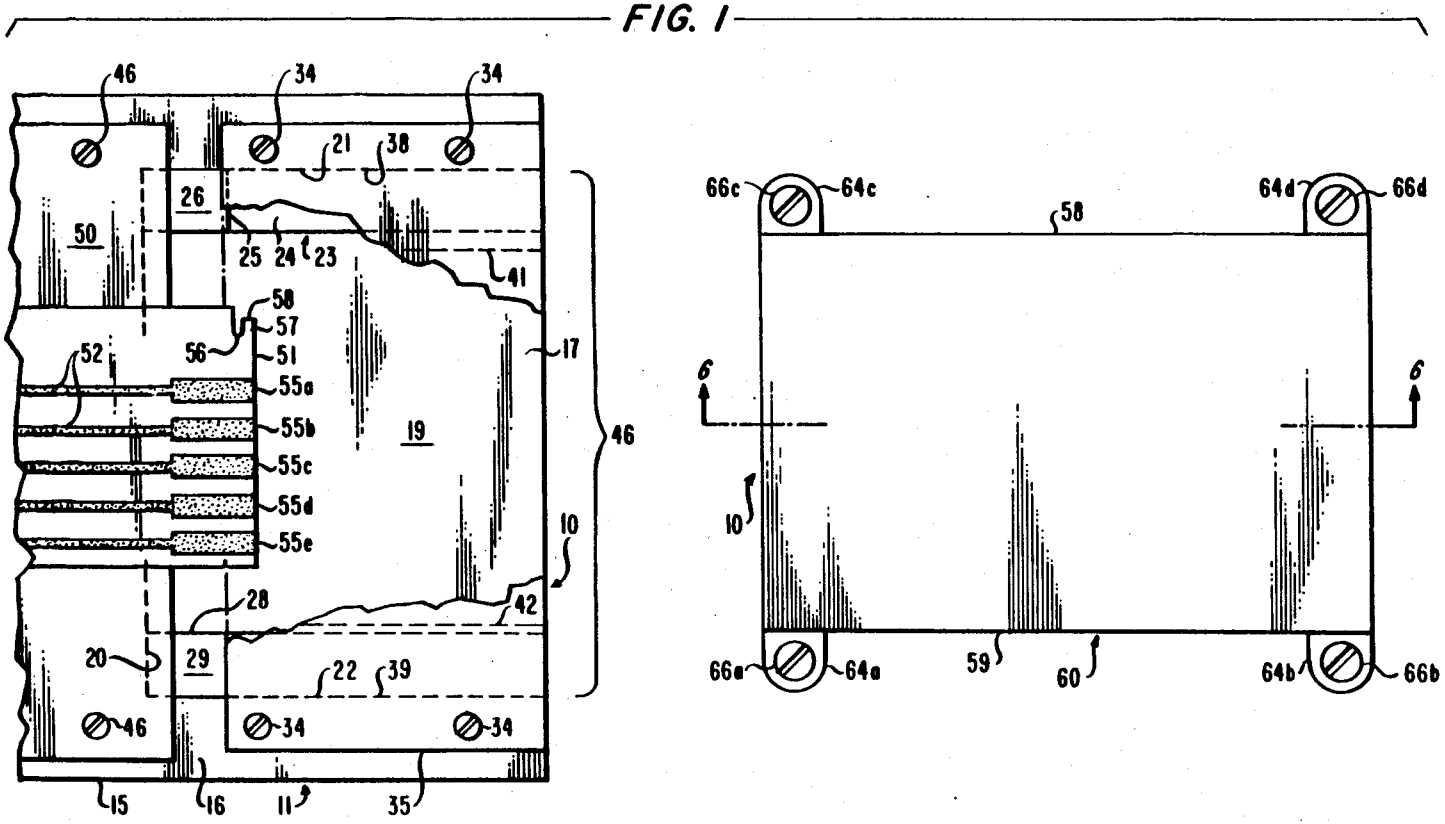
FIG. 1 is a plan view of an exemplary jack-plug connector apparatus according to the invention with the plug or cartridge connector part of the apparatus being separated from the jack part thereof.
Figure 2:
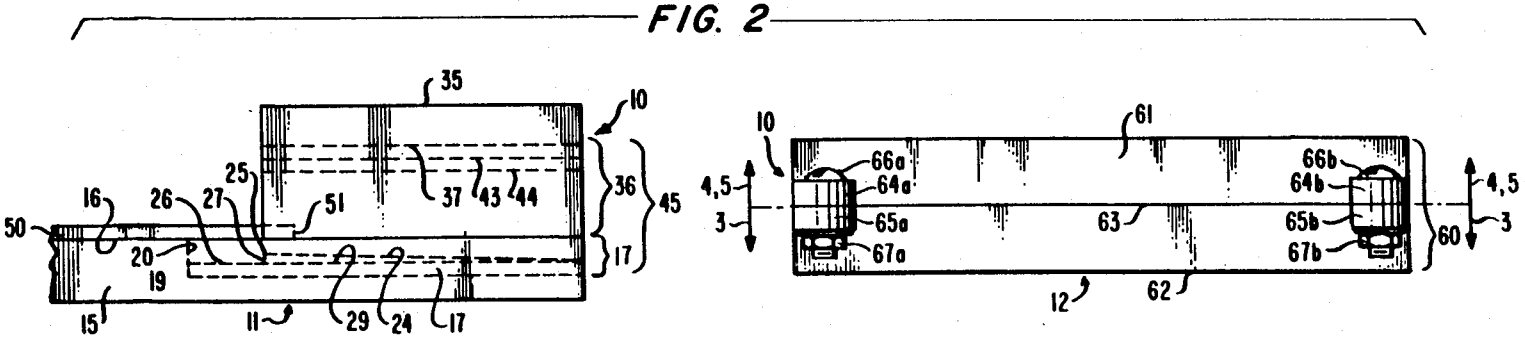
FIG. 2 is a front elevation of the FIG. 1 apparatus.

Referring now to FIGS. 1 and 2, the reference numeral 10 generally designates an electric connector apparatus comprising an electrical equipment jack 11 and a cartridge connector 12 serving as a plug in relation to jack 11.

Jack 11 comprises a horizontal insulative base 15 having formed in its top surface 16 a longitudinally-extending lower channel 17 of generally rectangular lateral-vertical cross section and open at the front of the jack. Channel 17 has a flat bottom 19, a back wall 20 and laterally spaced side walls 21 and 22 on it right and left hand sides looking into the channel from the front of jack 11. Side wall 21 is bordered within channel 17 by a longitudinally extending side shelf 23 having a top raised above channel bottom 19 and longitudinally divided into (a) a forward inclined ramp surface 24 rising rearwardly to a peak 25 and (b) a flat surface or "flat" 26 rearward of and below peak 25 and connected thereto by a surface extent forming a vertical shoulder 27. Sidewall 22 is likewise bordered within channel 17 by a side shelf 28 having a top which is raised above channel bottom 19 and has a surface 29 which is flat and at the same level as flat 26 of shelf 23.

Fastened to the top of base 15 by screws 34 is an insulative cover 35 of which part of the top is shown broken away in FIG. 1. Formed in the top of cover 35 is an upper channel 36 extending longitudinally through the cover and of generally rectangular lateral-vertical cross section and having a flat top wall 37 and side walls 38, 39 coplanar with respectively the walls 21, 22 of lower channel 17. The lower side shelves 23, 28 in channel 17 are matched by upper side shelves 41, 42 in channel 36 with the bottom surface 43 of side shelf 41 being slightly higher than the bottom surface 44 of side shelf 42. The lower and upper channels 17 and 36 form in jack 11 a recessed guideway 45 having an opening 46 thereinto from the front of the jack.

The jack base 15 has mounted thereon by screws 46 an insulative carrier in the form of a stiff printed wiring board 50 of which the front corners are cut off to form at the front of the board a tablike board free end 51 projecting from the back 20 of guideway 45 longitudinally forward from such back in centrally disposed relation in the lateral-vertical cross-section of the guideway. Adjacent that free end, the board 50 has on its top surface a plurality of printed electroconductive paths 52 terminating forwardly in respective conductive electric-contact portions or terminals 55*a*, 55*b*, 55*c*, 55*d*, 55*e*. Free end 51 further has formed in its right hand side a U-shaped notch 56 separated from the front of end 51 by a lateral prong 57 laterally terminating short of the right lateral edge of end 54 so as to leave a passing space 58 between the end of that prong and the line of such edge.

Referring now to cartridge connector 12, it comprises a cartridge 60 with laterally-spaced longitudinal side walls 58 and 59 and having upper and lower hollow synthetic-resinous rectangular housings 61 and 62 which meet together at an interface 63 to constitute the complete cartridge enclosure. Upper housing 61 at its corners has four laterally projecting coupling bosses 64*a*–64*d* having unthreaded vertical holes therein and having bottom end faces coplanar with interface 63 and top end faces below the top of housing 61. Lower housing 62 at its corners has four corresponding laterally projecting coupling bosses 65*a*–65*d* having formed therein vertical unthreaded holes respectively registering with those of bosses 64*a*–64*d*, bosses 65*a*–65*d* having top end faces coplanar with interface 63 and bottom end faces above the bottom of lower housing 62. The upper and lower housings 61 and 62 are coupled together by screws 66*a*–66*d* with nuts 67*a*–67*d* thereon, each of such screws passing down through the holes in the top and then a bottom one of a corresponding pair of the bosses 64, 65 to project downward beyond the lower boss in that pair. The one of the nuts 67*a*–67*d* corresponding to that screw is then threaded onto the bottom thereof and tightened. The tightening of nuts 67 on screws 66 firmly fasten together the upper and lower housings 61 and 62. The tops and bottoms of screws 66 are below and above the top and bottom, respectively of cartridge 60.

Looking into the interior of lower housing 62 (FIG. 3), that interior is bounded by a bottom wall 70, a back wall 71, a front wall 72 and laterally spaced longitudinal side walls 73 and 74, all such walls being integral parts of and provided by housing 62. Front wall 72 has formed in its top a laterally wide transversely shallow slot 75 passing longitudinally through the wall in laterally centered relation therewith and of rectangular lateral-transverse cross section. Projecting longitudinally inward from front wall 72 to either side of slot 75 are a pair of stop lugs 76 integral with wall 72 and bottom wall 70. Spaced rearward of front wall 72 to be separated therefrom by a portion 77 of bottom wall 70 is a cross wall 78 extending between side walls 73, 74 in parallel relation to front wall 72. Rearward of cross wall 76, each of the side walls 73, 74 has joined thereto two longitudinally spaced guide studs 79 projecting laterally inwards from those walls and extending upward from bottom wall 70 to a height less than that of such side walls, studs 79 being integral with both the associated side wall and the bottom wall. A lower lateral cylindrical roller 80 with an axis 81 is shown as received in lower housing 62 to be in contact on its transversely outward side with cartridge wall portion 77 and to be cradled between stop lugs 76 and cross wall 78.

Figure 3:
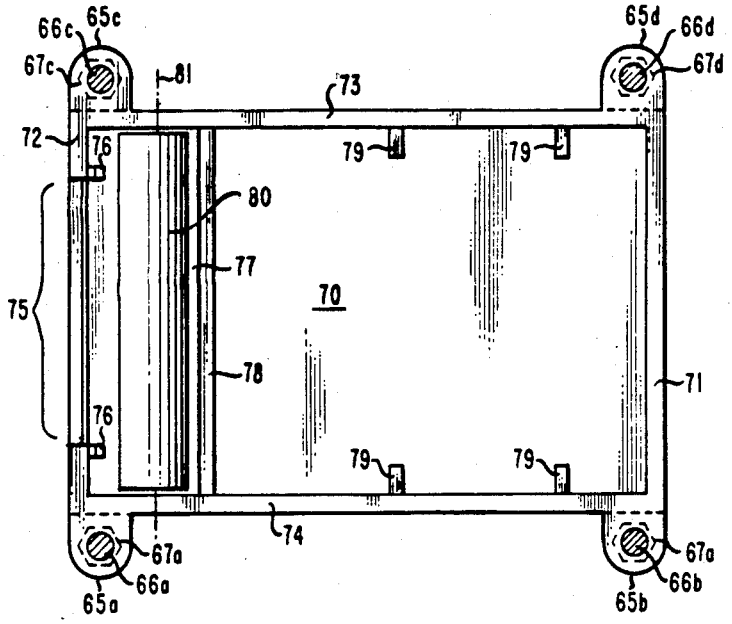
FIG. 3 is a plan view, taken as indicated by the arrows 3—3 in FIG. 2, of the lower housing and roller of the cartridge connector part of the FIG. 1 apparatus.
Figure 4:
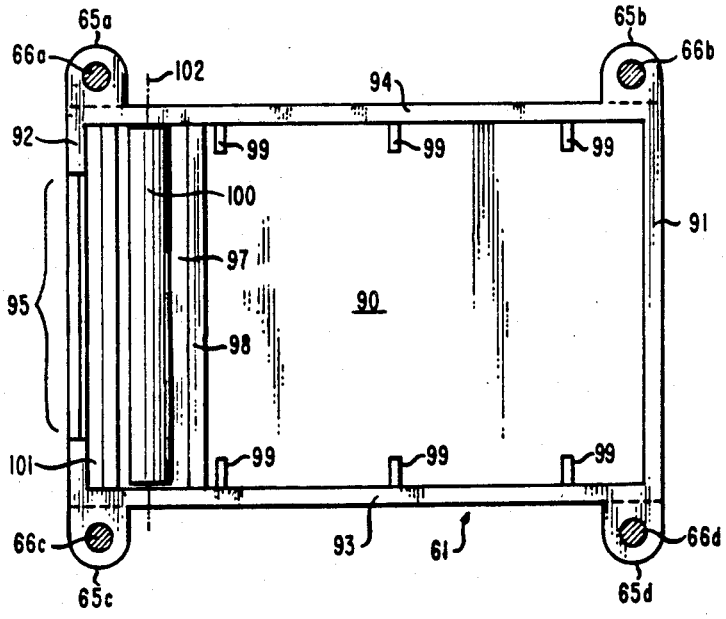
FIG. 4 is a bottom view, taken as indicated by the arrows 4—4 in FIG. 2 of the upper housing and upper roller of the cartridge connector part of the FIG. 1 apparatus when there is no flex bond unit in such part.

As will be evident by comparison of FIG. 3 with the FIG. 4 bottom view of upper housing 61, that upper housing's interior is much like that of lower housing 62. Features of the upper housing similar to corresponding features of the lower housing are a top wall 90 (equivalent to bottom wall 70 of housing 62), a back wall 91, a front wall 92, side walls 93 and 94, a slot 95 in the front wall 92, a top wall portion 97, a cross wall 98 separated from front wall 92 by top wall portion 97, guide studs 99 associated with side walls 93 and 94, and an upper lateral cylindrical roller 100 with an axis 102 and contacting on its transversely outward side the cartridge wall portion 97. Differences between the respective interiors of housings 61 and 62 are that the roller 100 in the upper housing is somewhat smaller in diameter than roller 80 in the lower housing, and that, in the upper housing, an additional cross wall 101 replaces the stop lugs 76 in the lower housing.

Figure 5:
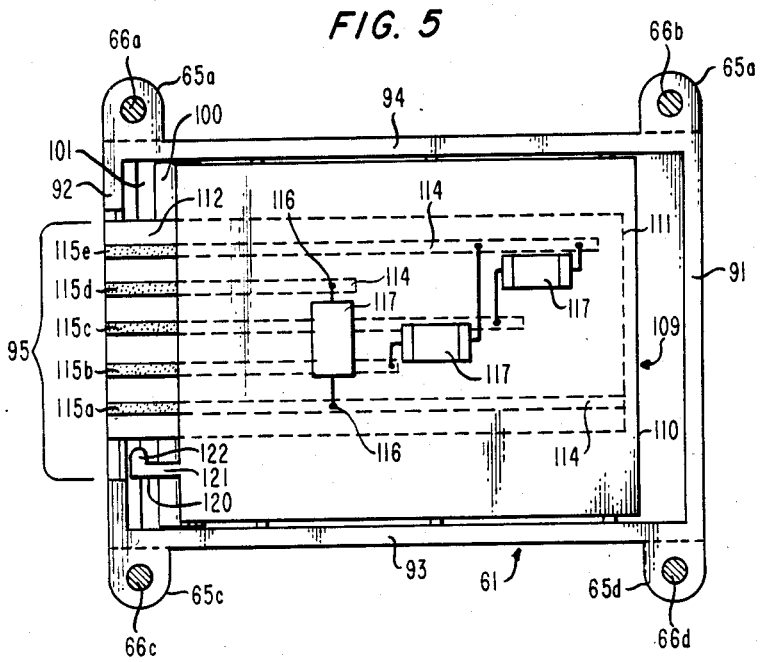
FIG. 5 is the same bottom view as FIG. 4 with the addition of a flex bond unit utilized in the mentioned cartridge connector part.

Referring now to FIG. 5, there is shown in superposition with upper housing 61 a flex-bond printed circuit unit 109 contained in cartridge 60 and comprising a stiff insulative printed wiring board 110 and a flexible or "flex" printed circuit sheet 111 bonded to board 110 and having a tail portion 112 projecting forward from the front edge of that board. Sheet 111 has thereon on its side towards board 110 a plurality of printed conductor paths 114 terminating on tail portion 112 in respective conductive electric contact portions 115*a*, 115*b*, 115*c*, 115*d*, 115*e* corresponding to and having the same lateral spacing as the conductor portions 55*a*–55*e* on board 50 (FIG. 1). From tail portion 112, conductors 114 extend rearwardly on sheet 111 to be electrically connected via plated through holes 116 in board 110 to various discrete electrical circuit components 117 mounted to the board on the bottom side thereof.

Board 110 has at its front a hook 120 disposed within the lateral extent of slot 95 and comprising a stem portion 121 adapted to fit into passing space 58 (FIG. 1) and a tang portion 122 adapted to fit into notch 56 (FIG. 1).

Figure 6:
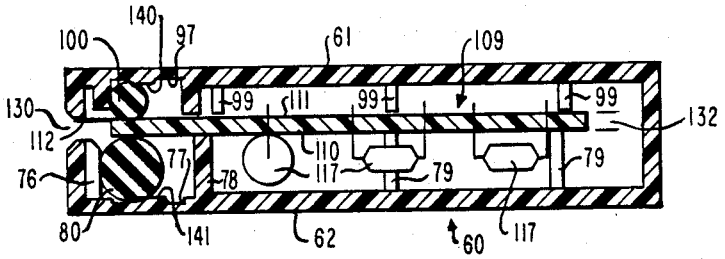
FIG. 6 is a front elevation in cross-section, taken as indicated by the arrows 6—6 in FIG. 1 of the cartridge connector part of the FIG. 1 apparatus.

As shown by FIG. 5, board 110 has a lateral extent which fits with close clearance between the side walls 93 and 94. Also as shown by FIG. 6, the flex-bond unit 109 fits with close clearance between the guide studs 99 in upper housing 61 and the guide studs 79 in lower housing 62. Accordingly the flex-bond unit is constrained in translatory and angular motion to be substantially movable only in the longitudinal direction. In that direction, however, the flex-bond unit is longitudinally displaceable back and forth within and relative to cartridge 60.

Noting further details shown in the FIG. 6 view of the assembled cartridge connector 12, the front slots 75 and 95 of lower and upper housings 62 and 61 cooperate to provide for cartridge 60 a front opening 130 for a passage 132 extending from such opening longitudinally into the cartridge interior through a transverse gap 131 between the inward sides of rollers 80, 100 and, rearward of that gap, laterally between the housing side walls 73, 74 and 93, 94 and transversely between the studs 79 and 99 in housings 62, 61. Flex-bond unit 109 is longitudinally movable in passage 132 between advanced and retracted positions at which, respectively, the front end of board 110 is in and out of the gap 131 between the rollers 80, 100.

These rollers are axleless or "free"0 cylindrical rollers each of a cross-section normal to the central axis thereof which is a circular cross section when the roller is undeformed. Rollers 80 and 100 are, however, each resiliently deformable in cross-section and, to that end, each of such rollers may be constituted of SE-756 silicon rubber. As long as the front end of board 110 is between those two rollers, each of them is resiliently deformed from circular cross section to thereby exert an inward force on flex-bond unit 109 and an opposite outward force on the one of cartridge wall portions 77 and 97 contacted by that roller. Those forces produce friction between the inward sides of the rollers 80, 100 and the flex-bond unit 109 and between the outward sides of such rollers and the mentioned cartridge wall portions. Hence, with the front end of board 110 being between the roller 80, 100, rearward movement of unit 109 causes roller 80 to roll without slip on both cartridge wall portion 77 and the underside of board 110 so as to longitudinally move rearward relative to cartridge 60. Concurrently, such rearward movement of unit 109 causes roller 100 to roll without slip on both cartridge wall portion 97 and the top surface of flex sheet 111 so as to longitudinally move rearward relative to cartridge 60 while remaining transversely opposite roller 80. Note in such connection that, in terms of relative motion, rollers 80 and 100 in moving rearward relative to cartridge 60 roll relatively rearward on cartridge wall portions 77 and 97 but relatively forward on the transversely opposite surfaces of unit 109 respectively contacted by those rollers. Thus, a rearward displacement of 2x" of unit 109 relative to cartridge 60 is needed in order to produce a rearward displacement "x" of the rollers relative to that cartridge.

The cartridge wall portion 97 has formed centrally within its lateral extent and between cross walls 98 and 101 an inwardly salient or convex promontory 140 which serves in relation to roller 100 as a detent providing yieldable resistance to movement of the roller from one longitudinal side to the other of the promontory. Moreover, the cross-walls 98 and 101 serve for roller 100 as caging means or stops whereby the longitudinal movement of that roller is limited at its opposite ends by contact with these two walls, and whereby roller 100 is prevented from escaping from cartridge 60 or moving rearward therein beyond the limit established by cross-wall 98. Cartrigde wall portion 77 has a similar inwardly salient promontory 141 serving as a like detent for roller 80, and that roller is caged between stop lugs 76 and cross wall 78. Thus, when rollers 80 and 100, are in positions on either the front side or rear side of their respectively associated promontories so as to be in contact with the cross wall (or stop lugs) on that side, such rollers are yieldably detained in such positions.

USE OF THE EMBODIMENT

One of many uses of the described electrical connector apparatus is when the jack 11 (FIG. 1) is a jack for telephone equipment such as a business telephone set, and it is desired to add to that set a service option provided by the circuitry on flex-bond unit 109. That circuitry is connected to such set by the described apparatus in a manner as follows.

Referring first to FIGS. 1 and 2, the cartridge connector 12 is moved by hand longitudinally towards jack 11 so that the cartridge 60 is slidably received in the recessed guideway 45 in the jack and is advanced towards the back of that guideway. In the course of that advance, the laterally spaced longitudinal side walls 58, 59 of cartridge 60 are guided by the side walls of the lower shelves 23, 28 and upper shelves 41, 42 while the bosses 64, 65 on the cartridge fit transversely between those top and bottom shelves with the lower ends of screws 66 riding on the top surfaces of shelves 23, 28. By virtue of the lower end of screw 66*c* so riding on bottom shelf 23, the cartridge 60 is, as it slides into guideway 45, elevated at its front right corner by contact between the screw 66*c* and ramp surface 24 to cause hook 120 (FIG. 5) be raised over prong 57 (FIG. 1) as the screw approaches the peak 25 of the ramp surface. After, however, passing that peak, the bottom end of screw 66*c* drops down onto flat 26 to cause tang 122 of hook 120 on board 110 in cartridge 60 to fall into notch 56 in board 50 in jack 11. In this way, the two boards 110 and 50 become interlocked to prevent their subsequent casual separation.

Now referring to the schematic diagrams, FIGS. 7A–7D, the first diagram 7A, depicts the connection stage wherein cartridge connector 12 is being advanced into guideway 45 in jack 11 but the above-described interlocking has not yet taken place, and the free end 51 of board 50 is still outside of cartridge 60. In that stage, rollers 80 and 100 are in their forward detailed positions and flex-bond unit 109 is at its advanced position in cartridge 30 at which the front end of the unit is in inter-roller gap 131 so that rollers 100 and 80 are resiliently deformed and their inner sides are in pressure contact with, respectively, the surface of flex sheet 111 away from board 110 and the surface of that board away from the flex sheet, the combined thicknesses of the flex sheet and board being interposed in that gap between the two rollers. In the FIG. 7A stage, the tail portion 112 of the flex sheet projects forwardly of the front end of board 110 towards and into the cartridge opening 130.

Figure 7A:
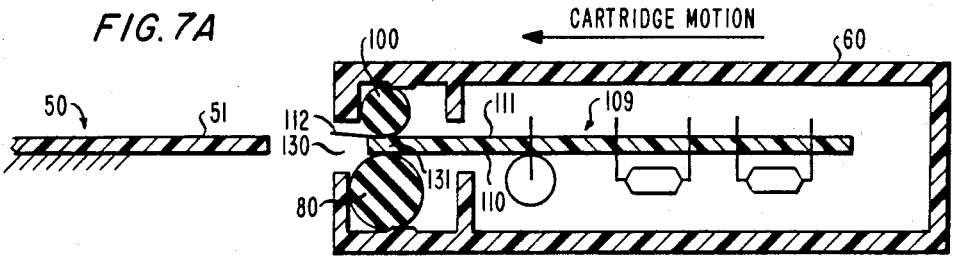
FIG. 7A–7D are schematic front elevational cross-sectional simplified showings of the FIG. 1 apparatus and depicting the use thereof.
Figure 7B:
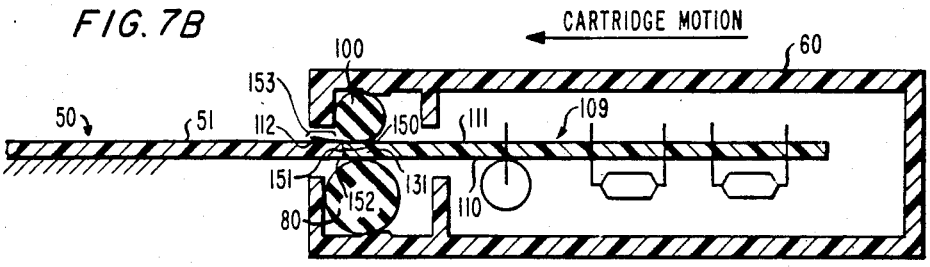

FIG. 7B represents the connecting stage at which cartridge 60 has advanced far enough into guideway 45 for the above-described interlocking to take place. Immediately after such interlocking occurs, the forward motion of cartridge 60 brings the front end face 150 of board 110 into abutting contact with the front end face 151 of the free end 51 of board 50 at an interface 152 formed between those two end faces and then located outwards of gap 131. With the two boards being in such abutting relation, tail portion 112 of flexible sheet 111 overlies board 50 to create between that board and sheet a longitudinal overlap 153 terminated forwardly and rearwardly at the locations of, respectively, the free end of flexible tail portion 112 and the front end face of board 50. Within a region of that overlap, the conductive electric-contact portions 55*a*–55*e* on board 50 (FIG. 1) are in face-to-face registration with their corresponding conductive electric contact portions 115*a*–115*e* on flexible tail 112 but are not yet pressed into firm contact therewith because that region is outwards of the inter-roller gap 131. Note that board 110 is of the same transverse thickness as board 50 and is transversely located to be coplanar with board 50.

Figure 7C:
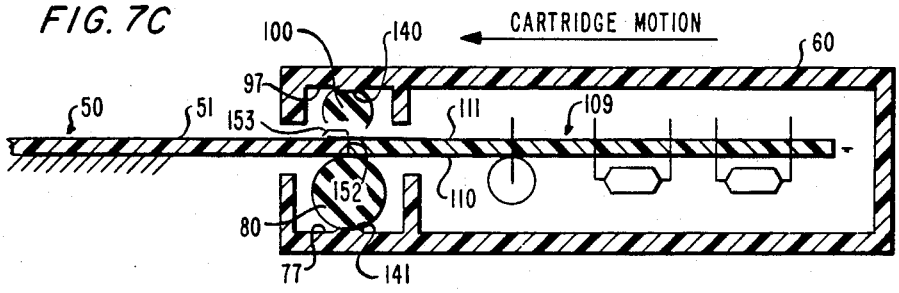

Once boards 50 and 110 have engaged as just described the continued forward motion of cartridge 60 in guideway 45 causes the stationary board 50 by continued abutment with board 110 to drive the bond-flex unit 109 rearwardly into cartridge 60 as depicted in FIG. 7*c*. Because of the friction between each of resiliently deformed rollers 80, 100 and unit 109 which is developed by the pressure contact between that roller and unit, the rearward driving of unit 10 relative to cartridge 60 causes those rollers to roll without slip on the surfaces contacted thereby of unit 110 and cartridge wall portions 77, 97 so as to escape from the forward positions in which those rollers have been previously detained by promontories 140, 141 and to move longitudinally rearward in cartridge 60 over those promontories. Such rearward movement of the rollers relative to the cartridge is also a forward movement of the rollers relative to unit 109 and board 50, and FIG. 7C shows the rollers 80, 100 at the moment they are transiting the interface 152 between boards 50 and 110 so as to be positioned in the overlap 153 of flex sheet 111 and free end 51 of board 50. Note that, because boards 110 and 50 are of the same thickness and have coplanar top and bottom surfaces, the transition of the rollers across interface 152 and onto the overlap 153 is smooth because the surfaces on which elements 80 and 100 roll on their inner sides are longitudinally flat surfaces so that the rollers in rolling thereon do not encounter any abrupt changes in surface contour.

Figure 7D:
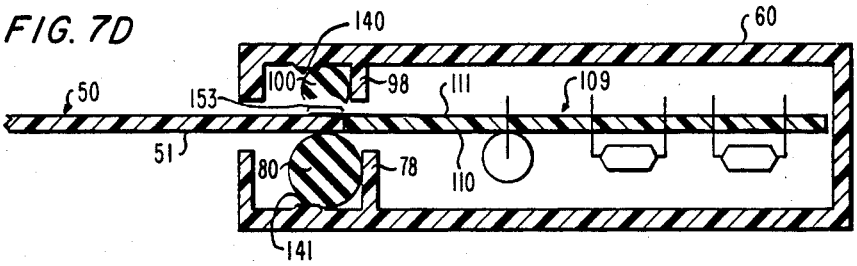

Continued forward motion of the cartridge 60 in guideway 45 causes further rearward driving of unit 109 in cartridge 60 (with accompanying further rolling of rollers 80, 100 and rearward movement thereof in the cartridge) until, as depicted in FIG. 7D, the rollers 80 and 100 completely roll over promontories 140, 141 and fetch up against cross walls 78, 98 to be yieldably detailed by these promontories and cross-walls in rearward detained positions for those rollers. At about the same time, the front of cartridge 60 comes into contact with the back wall 20 (FIG. 1) of guideway 45 to thereby stop further advance of the cartridge into the guideway. At this final stage in the connecting procedure, the inner sides of rollers 80 and 100 are longitudinally centered within the overlap 153 of flex sheet 111 and board 50, and those rollers 80 and 100 there exert respective inward forces on flex sheet 111 and on the free end 51 of board 50. Those inward forces cause the conductive portions 115*a*–115*e* and the conductive portions 55*a*–55*e* respectively on that sheet and board (FIG. 8) and face-to-face with each other to be pressed together so as to render each of such portions on the sheet in firm electromechanical contact with the corresponding conductive portion on such board. In this way, the circuitry on flex-bond unit 109 becomes reliably and durably connected via the conductive portions 55*a*–55*e* in jack 11 to circuitry within the telephone set of which the jack 11 (FIG. 1) is a part.

Figure 8:
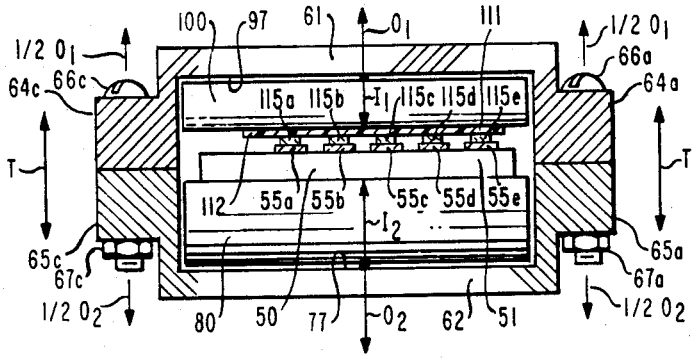
FIG. 8 is a schematic left side elevation in cross-section, taken as indicated by the arrows 8—8 in FIG. 7D, of the cartridge connector part of the FIG. 1 apparatus when such cartridge connector part is in use.

FIG. 8 is a diagram illustrative of the forces existing when the FIG. 7D stage of connection is reached. The resilient deformation of upper roller 100 between flexible sheet 11 and the backing means for that roller provided by upper cartridge housing 61 is the cause of inward transverse force $I_1$ transmitted from the roller through the tail portion 112 of flex sheet 111 to the conductive portions 115*a*–115*e* on that tail portion. Opposed to inward force $I_1$ is another equal transverse inward force $I_2$ from reactive means comprising lower roller 80 and lower housing 62 and transmitted through the free end 51 of board 50 to conductive portions 55*a*–55*e* on that free end. Those two inward forces $I_1$ and $I_2$ press together each of conductive portions 115*a*–115*e* with the correspondingly paired one of conductive portions 55*a*–55*e* so that the two conductive portions in each such pair thereof are rendered in firm, durable and reliable electromechanical contact.

An incident to such pressing together of contacts 55*a*–55*e* and 115*a*–115*e*, is the development of transversely outward reactive forces $O_1$ and $O_2$ of which $O_1$ is associated with and oppositely directed to force $I_1$ and works on upper housing 61, and of which $O_2$ is associated with and oppositely directed to force $I_2$ and works on the mentioned reaction means comprising roller 80 and lower housing means 62. Since forces $I_1$ and $I_2$ are equal and force $O_1$ and $O_2$ are equal to, respectively, $I_1$ and $I_2$, the forces $O_1$ and $O_2$ are equal in magnitude but oppositely directed to each other. Those two equal and opposite forces $O_1$ and $O_2$ are caused to mutually cancel each other by the coupling between upper housing 61 and the mentioned reaction means which is provided by screws 66 and nuts 67. The effect of the forces $O_1$ and $O_2$ on such screws and nuts is, of course, to place the length of each such screw between its head and the nut thereon under a tension force T produced by the oppositely directed urgings of reactive forces $O_1$ and $O_2$ on, respectively, housings 61 and 62.

Cartridge connector 12 may be removed from guideway 45 in jack 11 by following a disconnection procedure which is the reverse of the connection procedure described above, and the several stages of which disconnection procedure are illustrated by FIGS. 7D, 7C and 7B taken in that order. The events occurring during such disconnection procedure should be self-evident from the foregoing description of the connection procedure and, hence, will not be discussed further herein in detail. In order during the disconnection procedure to progress from the stage shown in FIG. 7B and at which, as earlier described, flex bond unit 109 and board 50 are interlocked by the fitting of tang 122 (FIG. 5) into notch 56 (FIG. 1), cartridge 60 while still in guideway 45 is maneuvered by hand during disconnection to tilt the right front corner of the cartridge upwards so as to disengage the tang from the notch, and the cartridge is then slid by hand all the way out of the guideway so as to fully separate cartridge connector 12 from jack 11 as depicted in FIG. 7A.

Some advantages among others of the described jack-plug connector apparatus 10 are as follows.

Since each of rollers 80 and 100 rolls without slip during the connection and disconnection procedures on the one of elements 111, 110 and 51 (see FIGS. 7C and 7D) which at the time is contacted by that roller, there is no wiping contact by either of these rollers which, particularly after numerous connections and disconnections of plug 12 and jack 11, might cause abrasion of and damage to ones of the conductive portions 55*a*–55*e* and 115*a*–115*e* pressed together as a result of the rolling action of the rollers.

Manipulation by hand of the back part of the cartridge connector 12 to move it into or out of guideway 45 in jack 11 is effective as described above to automatically make and break electromechanical contacts between the conductive portions 115*a*–115*e* in connector 12 and the conductive portions 55*a*–55*e* of jack 11 which are located at the back end of guideway 45 and thus not readily accessible. Thus, the disclosed jack-plug connector apparatus permits contact to be made and broken between conductive portions located at a vicinity to which there is no easy direct access.

The detect action of the rollers 80 and 100 provided by the promontories 140, 141 and the cartridge walls 78, 98 101 and stop lugs 76 provides to the user of apparatus 10 a good tactile feedback which signals to the person when contact has been fully made or broken between the conductive portions 55*a*–55*e* in jack 11 and conductive portions 115*a*–115*e* in cartridge connector 12.

The arrangement shown in FIGS. 7B, 7C, and 7D, wherein sheet 111 overlaps with board 50 and is mounted on board 110 of the same thickness as and abutting board 50 and wherein, moreover, roller 100 initially contacts flexible sheet 111 away from over overlap 153 (FIG. 7B) and thereafter rolls on the sheet onto that overlap, is an advantageous arrangement because roller 100 in the course of its rolling encounters no abrupt change in contour in the surface on which it rolls (which change might cause slip between such roller and surface), and the same is true of the rolling of roller 80 from off board 110 across interface 152 and onto the region of board 50 within overlap 153.

The fact that rollers 80 and 100 are free or axleless rollers and are backed over all of their lateral lengths by the cartridge wall portions 77 and 97 contacted by those rollers is a feature which which prevents the rollers from bowing in their lateral dimension to thereby produce unequal pressures on various pairs of the conductive portions 55*a*–55*e* and 115*a*–115*e* pressed into contact by those rollers.

The above described embodiment being exemplarly only, it is to be understood that additions thereto, omissions therefrom and modifications thereof can be made without departing from the spirit of the invention. For example but without restriction, many of the advantages of the invention can be obtained when just one of the two described rollers is used. Further, for example but without restriction, while apparatus 10 has been disclosed as connecting contacts in jack 11 to circuitry all contained within the plug part 12 of such apparatus, such apparatus may be readily modified to connect circuitry outside of plug part 12 but via that part to such contacts in jack 11 by extending flexible sheet 11 and the conductive paths 114 thereon to pass out of the rear of cartridge 60 through a slot (not shown) in such rear and then to some location away from cartridge 60 at which such paths 114 are adapted to be connected to such circuitry.

Accordingly, the invention is not to be considered as limited save as is consonant with the scope of the following claims.

What is claimed is:

1. A cartridge connector for connecting to conductive electric-contact portions on a stiff insulative board adjacent a free end thereof, said connector comprising: a cartridge having a front opening for a longitudinal passage therein, a pair of laterally extending rollers disposed in said cartridge adjacent said opening to be transversely on opposite sides of said passage so as to be separated by a transverse gap, each of said rollers being backed on its side away from said gap by a cartridge wall portion on which said roller can roll to longitudinally move in said cartridge, a stiff displaceable member mounted in said cartridge to be in transverse registration with said gap and to extend longitudinally rearward therefrom, said member being longitudinally movable in said passage between advanced and retracted portions at which such member's front end is, respectively, in and out of said gap, and a flexible insulative sheet mounted on said member and having a tail portion extending forwardly from said member to be in said gap when said member is retracted therefrom, said tail portion carrying thereon a plurality of laterally spaced conductive electric-contact portions matching said portions on said board and adapted to be pressed within said gap into contact with such board contacts by said rollers upon said board's free end being inserted in said opening and then in said gap between said rollers to engage and then rearwardly drive said member from its advanced to its retracted position.

2. A cartridge connector according to claim 1 further comprising cage means in said cartridge for each of said rollers and establishing fixed forward and rearward limits to the longitudinal movement of each such roller.

3. A cartridge connector according to claim 1 in which each of said rollers is a cylindrical roller which has a central laterally extending axis and is resiliently deformable in its cross-section normal to said axis, said cross-section being circular when said roller is undeformed.

4. A cartridge connector according to claim 3 in which each of said cartridge wall portions has an inwardly salient promontory providing a detent yieldably opposing rolling of such roller from one side to the other of such promontory.

5. A cartridge connector according to claim 1 further comprising guide means included in the interior of said cartridge and cooperable with said displaceable member to constrain its translatory and angular movement relative to said cartridge so that such member is substantially movable solely longitudinally within said passage.

6. A cartridge connector according to claim 1 in which said displaceable member is a printed wiring board having discrete electrical circuit components thereon on the side thereof away from said flexible sheet, and in which said flexible sheet has on its side towards said board a plurality of printed conductor paths connecting such components through plated through holes in such board to said conductive portions on said tail portion of said sheet.

7. Connector apparatus comprising, an assemblage of two insulative printed conductor carriers having an overlap and respective conductive portions face-to-face with each other within said overlap, a roller contacting said assemblage on one side thereof, roller backing means providing a bearing surface outwards of and in contact with said roller, such backing means being movable relative to said assemblage to roll said roller on said surface so as to bring said roller into registration with said portions, reaction means contacting said assemblage on the side thereof opposite said roller and enabling said roller and such reaction means to exert on such assemblage oppositely directed inward forces which press together said conductive portions respective to said two carriers to produce firm electromechanical contact therebetween, and force-transmitting means coupling together said backing means and reaction means to effect mutual cancellation of the reactive outward forces developed thereon by said inward forces.

8. Apparatus according to claim 7 in which said roller is a circular cylindrical roller which is resiliently deformable in cross-section to generate said inward force exerted by such roller on said assemblage.

9. Apparatus according to claim 7 in which said reaction means comprises an additional roller contacting said assemblage opposite said first-named roller and an additional backing means providing an additional bearing surface outward of and in contact with said additional roller, said additional backing means and first-named backing means being movable together relative to said assemblage to produce concurrent rollings of their respectively associated rollers both on the respective bearing surfaces of such two backing means and on such assemblage so as by such rollings to bring both such rollers into registration with said conductive portions.

10. Apparatus according to claim 9 in which said first-named backing means and additional backing means comprise separate housings for, respectively said first-named and said additional rollers, and in which said force transmitting means comprises means for coupling said housings together to form a cartridge enclosing such rollers.

11. Connector apparatus comprising, an assemblage of first and second insulative longitudinal printed wire conductor carriers transversely superposed with each other to have a longitudinal overlap, and each having in a region in said overlap a plurality of laterally spaced conductive portions in face-to-face registration with corresponding portions of the other carrier, a lateral roller on one transverse side of said assemblage and in contact with said first carrier at an initial position thereon longitudinally offset from said region, roller backing means disposed transversely outwards of said roller and having a longitudinal bearing surface in contact therewith, said backing means being longitudinally movable relative to said assemblage to roll said roller on said surface and first carrier so as to move said roller from said position into said region, reaction means disposed on the other transverse side of said assemblage to contact said second carrier opposite said roller and to counter inward force exerted by said roller in said region on said assemblage with oppositely directed inward force exerted by said reaction means on said assemblage so as to cause said conductive portions of said two carriers to be pressed together in said region between said roller and reaction means, and force-transmitting means coupling said backing means and reaction means to effect mutual cancellation of the outward forces respectively produced on such two means as reactions to said inward forces.

12. Connector apparatus according to claim 11 in which said roller contacts said first carrier on the transverse side thereof away in the transverse dimension from said second carrier.

13. Connector apparatus according to claim 11 in which one and the other of said first and second carriers are, respectively, flexible and stiff members extending longitudinally rightward and leftward, respectively, away from the longitudinal overlap of such two members, and in which said apparatus further comprises a third stiff member of the same transverse thickness as, and disposed rightward of and in end-abutting relation with the stiff one of said first and second members so that, an extent of said third member immediately rightward of said overlap is in transversely superposed contacting relation with the flexible one of said first and second members.

14. Connector apparatus according to claim 11 in which said roller is at least laterally coextensive with the lateral extent occupied on said first and second carriers by said conductive portions thereon and, moreover, is a circular cylindrical roller resiliently deformable in its cross-section to generate said inward force exerted by said roller on said assemblage, and in which said bearing surface over the longitudinal range of rolling thereon by said roller is at least laterally coextensive with said rollers lateral extent and is stiff against lateral deformation over such extent so as to cause said conductive portions to be pressed together with force which is substantially uniform for all contacting pairs of such contacts.

15. Connector apparatus comprising, an electrical equipment jack having therein a recessed guideway with an opening thereinto at the front of said jack, a first insulative member mounted at the back of said guideway to have a free end projecting forwardly from said back centrally within said guideway, said member having thereon adjacent said end at least one conductive electrical contact portion, a cartridge slidably receivable front end first into said guideway and having at its front an opening for insertion into the carriage interior of said member's free end during cartridge reception in said guideway, a second insulative member in said cartridge and having on its front at leat one conductive electrical-contact portion adapted during such insertion to register face-to-face with said conductive portion on said first member, roller means disposed in said cartridge and responsive to insertion therein of said first member's free end to press said conductive portions on respectively said two members into firm electromechanical contact, and a third member carrying said second member and movably mounted in said cartridge to undergo rearward displacement relative thereto in response to reception of said first member in said cartridge, and in which said roller means is responsive to said displacement to move by rolling in said cartridge so as to bring said roller means into registration with said conductive portions.

16. Connector apparatus according to claim 15 in which said free end of said first member is adapted to abut the front end of said third member so as during said insertion to drive said third member to undergo said displacement thereof, and in which said apparatus further comprises latch means for locking together said first and third members upon reception of said cartridge in said guideway.

17. Connector apparatus according to claim 15 further comprising detent means for yieldably opposing removal of said cartridge from said guideway upon full reception of said cartridge therein.

18. A method for electrically interconnecting two conductive electric-contact portions which are respectively on first and second longitudinally extending insulative members adjacent respective ends of such members, said method comprising, placing said two members in longitudinal alignment so as at such ends thereof they have a longitudinal overlap with said portions on such two members being in face-to-face registration with each other in a region within such overlap, engaging by a roller the side of said first member away from said second member at an initial position on said first member longitudinally offset from said region, maintaining said two members stationary relative to one another, and rolling said roller on said first member to move said roller from said offset position into a position in said region and to there cause pressing together of said conductive portions on said two members into firm electromechanical contact.

19. The method according to claim 18 in which said first and second members extend longitudinally rightward and leftward, respectively, from said longitudinal overlap thereof, and in which said method comprises the further steps of providing rightward of said overlap a third longitudinally extending member of the same thickness as said second member and in abutting relation with said end thereof and in superposed contacting relation rightward of said overlap with said first member, engaging the side of said third member away from said first member by an additional roller at an initial position at which it is disposed opposite said first-named roller so as to be offset from said region, and rolling said additional roller first on said third member and then onto said first member so as to remain opposite said first-named roller during said rolling thereof, and so as to bring said additional roller into said region to there cooperate with said first-named roller in the pressing together of said conductive portions.

20. Connector apparatus comprising an assemblage of two conductor carriers having an overlap and respective conductors face-to-face with each other within the overlap, a roller associated with the assemblage and being movable relative to the assemblage, and means for rolling the roller on one of the carriers from a position in which the roller is offset to one side from the overlap of the conductors that are face-to-face with each other into a position in which the roller is in registration with the conductors that are face-to-face with each other to press the conductors together, the two conductor carriers remaining stationary relative to one another as the roller is moved from the offset position into the position in which it is in registration with the conductors that are face-to-face with one another.

* * * * *